US009845230B2

(12) United States Patent
Groninger et al.

(10) Patent No.: US 9,845,230 B2
(45) Date of Patent: Dec. 19, 2017

(54) CLOSING DEVICE INCLUDING INTERTWINED SLIDING CAGE AND GRIPPING PART

(71) Applicant: Groninger GmbH & Co. KG, Schnelldorf (DE)

(72) Inventors: Volker Groninger, Crailsheim (DE); Ralf Glock, Rudolfsberg (DE)

(73) Assignee: GRONINGER GMBH & CO. KG, Schnelldorf (DE)

( * ) Notice: Subject to any disclaimer, the term of this patent is extended or adjusted under 35 U.S.C. 154(b) by 425 days.

(21) Appl. No.: 14/683,683

(22) Filed: Apr. 10, 2015

(65) Prior Publication Data

US 2015/0217982 A1 Aug. 6, 2015

Related U.S. Application Data

(63) Continuation of application No. PCT/EP2013/071188, filed on Oct. 10, 2013.

(30) Foreign Application Priority Data

Oct. 12, 2012 (DE) ..... 10 2012 020 026

(51) Int. Cl.
*B67B 3/20* (2006.01)

(52) U.S. Cl.
CPC ..... *B67B 3/2066* (2013.01)

(58) Field of Classification Search
CPC ..... B67B 3/20; B67B 3/2066; B65B 7/2835; Y10T 279/17256

(Continued)

(56) References Cited

U.S. PATENT DOCUMENTS 1,585,820 A * 5/1926 Baum ..... B67B 3/14 53/330
2,165,132 A * 7/1939 Curtin ..... B67B 3/18 413/2

(Continued)

FOREIGN PATENT DOCUMENTS

CH 687759 A5 * 2/1997 ..... B67B 3/20
DE 9000849 U1 3/1990

(Continued)

OTHER PUBLICATIONS

PCT Search Report & Written Opinion for PCT Application No. PCT/EP2013/071188 dated Jan. 23, 2014; 11 pages.

(Continued)

*Primary Examiner* — Stephen F Gerrity
(74) *Attorney, Agent, or Firm* — Reising Ethington, P.C.

(57) ABSTRACT

A closing device, in particular for bottles, jars, pots or similar packaging containers for pharmaceutical or cosmetic products, having a rotationally drivable screw head for screwing a closure, for example a screw cap, onto the container which screw head has on a carrier a gripping part for grasping a closure and is actuable between a release position and a clamping position. The gripping part is embraced by a sliding cage for actuation by relative movement. Both the gripping part and the sliding cage are configured as a monolithic component and the two are intertwined in such a way that parts of the sliding cage reach through openings in the gripping part into the interior thereof and as far as a lifting apparatus in the carrier.

19 Claims, 4 Drawing Sheets

(58) Field of Classification Search
USPC ..... 53/317, 331.5, 351, 356; 279/37; 294/116
See application file for complete search history.

(56) References Cited

U.S. PATENT DOCUMENTS

| | | | | | |
|---|---|---|---|---|---|
| 2,507,127 | A * | 5/1950 | True | E21B 19/06 | 294/199 |
| 2,670,118 | A * | 2/1954 | Young | B65B 7/28 | 53/351 |
| 3,178,217 | A * | 4/1965 | Bargel | B65B 21/12 | 294/119.3 |
| 3,554,594 | A * | 1/1971 | Thoma | B65B 21/12 | 294/100 |
| 3,981,673 | A * | 9/1976 | Sokolow | B29C 49/4205 | 294/115 |
| 4,093,296 | A * | 6/1978 | Itoh | B65G 47/90 | 294/115 |
| 4,178,733 | A * | 12/1979 | Dankert | B67B 3/2073 | 53/331.5 |
| 4,745,729 | A * | 5/1988 | Bethge et al. | B67B 3/2066 | 53/331.5 |
| 4,768,428 | A * | 9/1988 | Silvestrini et al. | A23N 4/04 | 294/106 |
| 5,295,723 | A * | 3/1994 | Kronseder | B65B 21/12 | 294/100 |
| 5,851,042 | A * | 12/1998 | Bankuty et al. | B65G 47/90 | 279/37 |
| 6,044,626 | A | 4/2000 | Harper et al. | | |
| 6,170,232 | B1 | 1/2001 | VandeGeijn | | |
| 7,322,165 | B2 | 1/2008 | Spether | | |
| 8,375,682 | B2 | 2/2013 | Zanini et al. | | |
| 2004/0226261 | A1* | 11/2004 | Graffin | B67B 3/2073 | 53/75 |
| 2007/0068117 | A1 | 3/2007 | Lang et al. | | |
| 2008/0028892 | A1* | 2/2008 | Cirio | B67B 3/2066 | 81/3.4 |
| 2008/0078146 | A1* | 4/2008 | Cirio | B67B 3/2066 | 53/490 |

FOREIGN PATENT DOCUMENTS

| | | | | |
|---|---|---|---|---|
| DE | 10232846 | A1 | 2/2004 | |
| EP | 0536460 | A1 * | 4/1993 | B67B 3/2073 |
| WO | WO2005054113 | A1 | 6/2005 | |
| WO | WO2009016501 | A1 | 2/2009 | |

OTHER PUBLICATIONS

English Translation of PCT Search Report & Written Opinion for PCT Application No. PCT/EP2013/071188 dated Apr. 23, 2015; 7 pages.

German Examination Report for German Application No. DE 10 2012 020 026.9; 5 pages, dated Aug. 29, 2013.

* cited by examiner

CLOSING DEVICE INCLUDING INTERTWINED SLIDING CAGE AND GRIPPING PART

CROSS-REFERENCE TO RELATED APPLICATIONS

This application is a continuation of international patent application PCT/EP2013/071188, filed on Oct. 10, 2013, which claims the priority of German patent application DE 10 2012 020 026.9, filed Oct. 12, 2012, the whole contents of these applications are hereby included by reference.

BACKGROUND

The invention relates to a closing device, in particular for bottles, jars, pots or similar packaging containers for pharmaceutical or cosmetic products, having a rotationally drivable screw head for screwing a closure, for example a screw cap, onto the container which screw head has on a carrier a gripping part for grasping a closure and is actuable between a release position and a clamping position.

In the closure of containers in the cosmetics and pharmaceutical sector, rotating screw heads are used. In these, the gripping part has jaws which are movable by joints in a pivot motion between the release position and the clamping position and consist of metal. Each screw head further has a multitude of further component parts for its functionality. Owing to the large number of components, such screw heads are complicated and heavy. They require a relatively high complexity of assembly. Another drawback is a relatively large moment of inertia, which is an obstacle to a desired increase in the number of cycles. Desired shorter screwing times lead to difficulties in the controllability of the tightening torque of closures which are to be screwed on.

It is an object to provide a closing device of the type stated in the introduction, which is simplified by fewer components, enables a reduced weight and a reduction in costs and has a lower moment of inertia, wherein, due to the reduced moment of inertia, the tightening torque shall be better controllable and an increase in the number of cycles and a resulting shorter screwing time is achieved.

SUMMARY

There is provided, according to one aspect, a closing device, having a rotationally drivable screw head for screwing a closure onto the container, which screw head has on a carrier a gripping part for grasping a closure and is actuable between a release position and a clamping position, wherein the gripping part is embraced by a sliding cage for actuation by relative movement, and in that both the gripping part and the sliding cage are configured as a monolithic component and the two are intertwined in such a way that parts of the sliding cage reach through openings in the gripping part into the interior thereof and as far as a lifting apparatus in the carrier.

According to another aspect, the closing device, in terms of the screw head, is reduced practically to just two components, namely the one-piece gripping part on the one hand and the likewise one-piece sliding cage on the other hand, which latter embraces the gripping part at the end from outside, for actuation thereof, and due to the entwinement with an integral functional part, reaches through openings in the gripping part into the interior thereof, where the lifting apparatus in the carrier acts on the sliding cage for relative displacement of the same relative to the gripping part. An extremely simple design is thus obtained. The number of components, the production costs and the weight are substantially reduced. The moment of inertia, too, is lowered. In addition, a low complexity of assembly is obtained. Overall, the present closing device leads to a considerable reduction in costs and simplification of the screw head. Due to the lowered weight and the reduced moment of inertia, the tightening torque involved in the screwing on of a closure is better controllable and an increase in the number of cycles is realizable with consequential shorter screwing time.

Advantageous refinements of the present closing device emerge from the dependent claims. Further details and advantages are defined in the following description and are also apparent from the drawings.

BRIEF DESCRIPTION OF THE DRAWINGS

The invention is explained in greater detail below with reference to an illustrative embodiment shown in the drawings, wherein.

DESCRIPTION OF PREFERRED EMBODIMENTS

Figure 1:
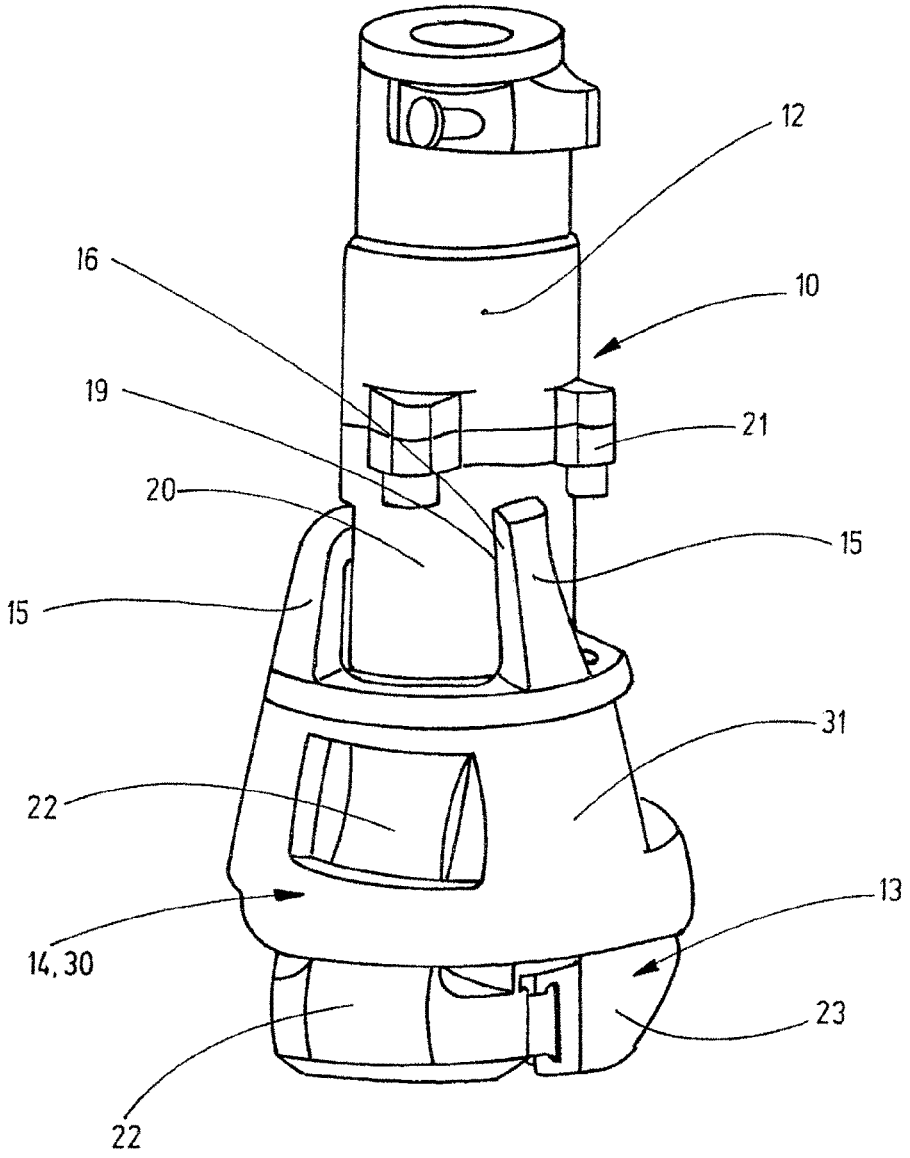
FIG. 1 shows a schematic side view with partial perspective view of a screw head of a closing device in the release position.
Figure 2:
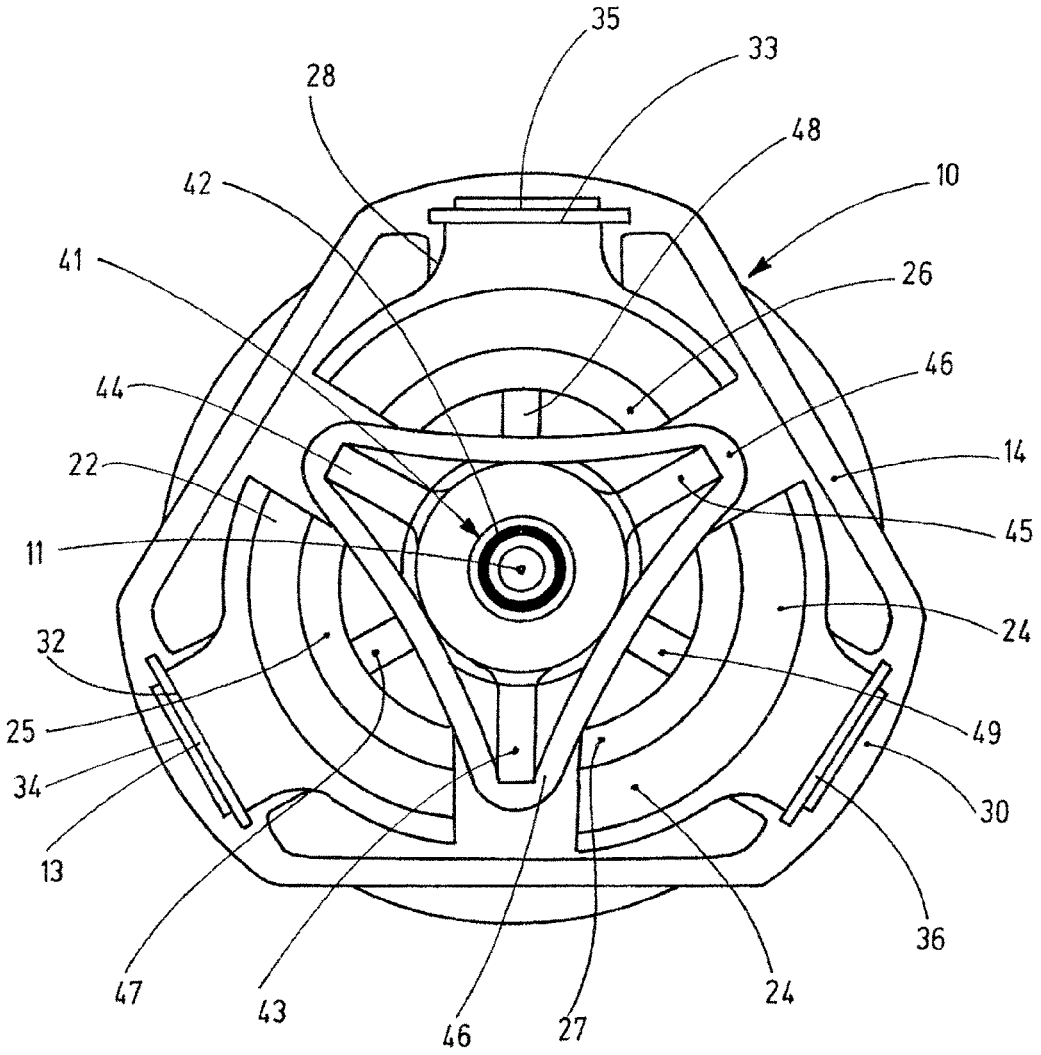
FIG. 2 shows an end-face view of the screw head in FIG. 1.

In the drawings, a screw head 10 of a closing device, in particular for bottles, jars, pots or similar packaging containers for pharmaceutical or cosmetic products, is shown in schematic representation. The screw head 10 is rotationally drivable by means of a drive device (not further shown) in order to screw a closure, for example a screw cap, onto the container. Moreover, the screw head 10 is movable up and down in the direction of its center longitudinal axis 11.

Figure 3:
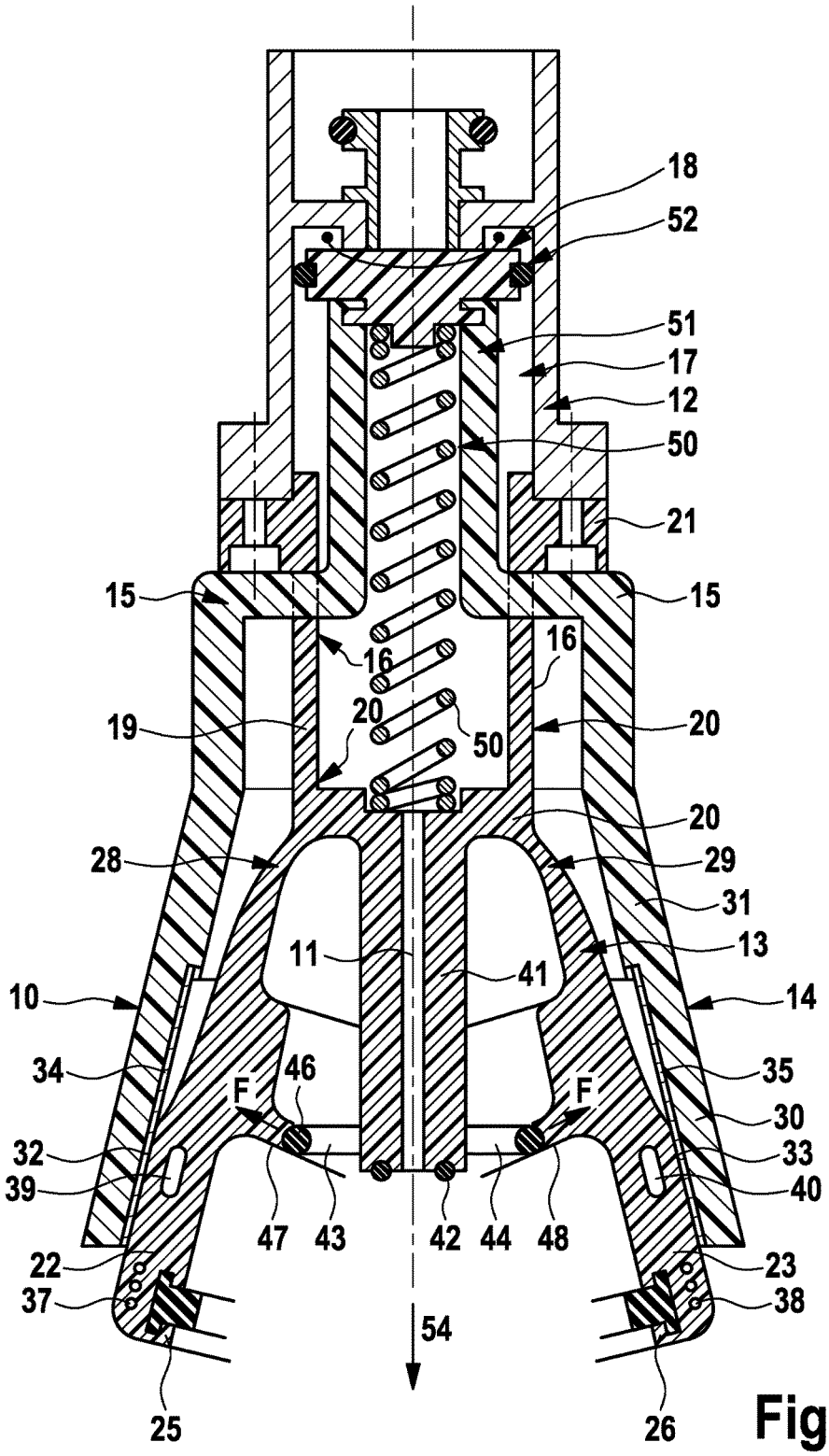
FIG. 3 shows a schematic, partially sectioned side view of the screw head in FIG. 1 in its release position.
Figure 4:
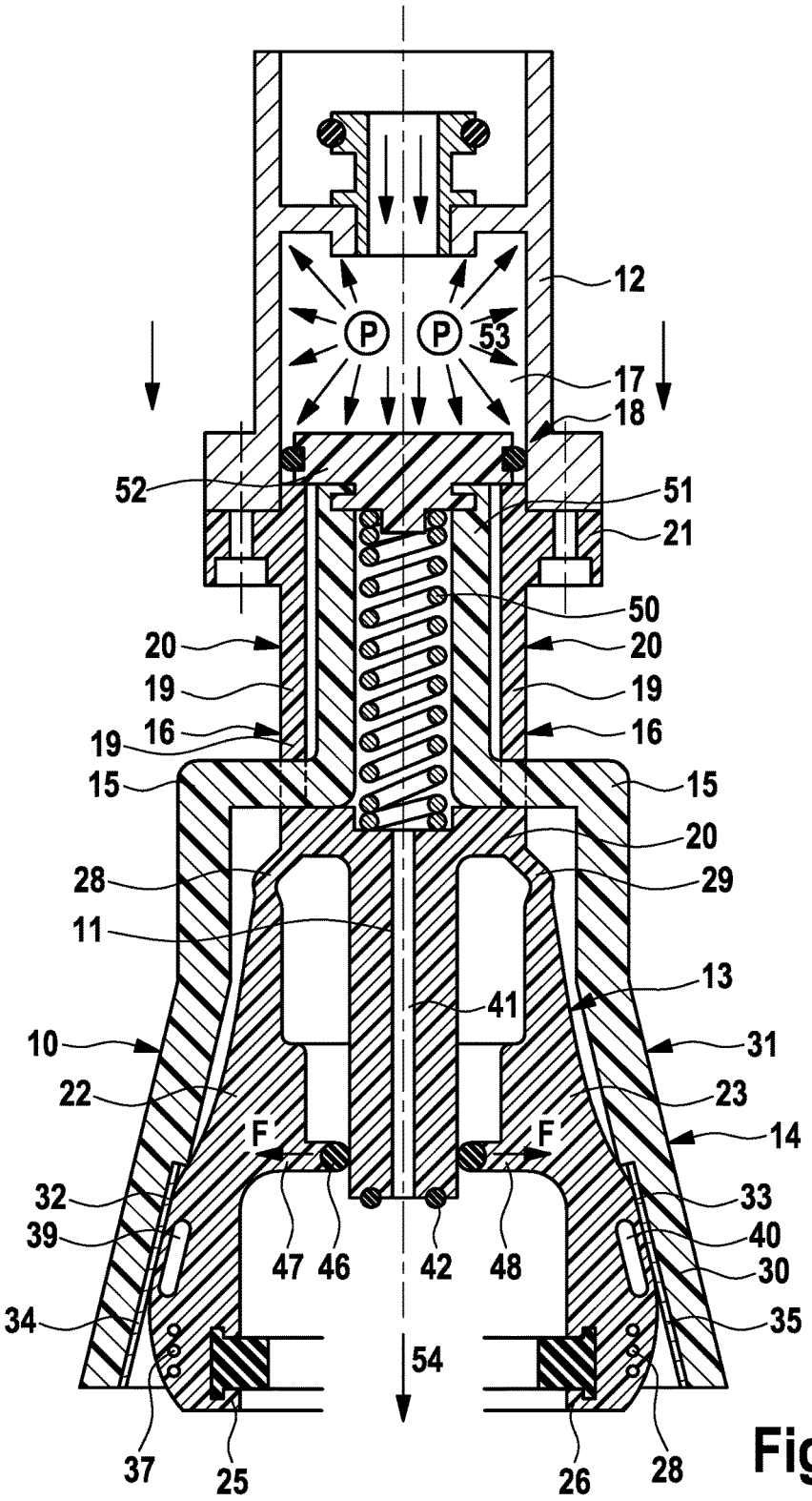
FIG. 4 shows a schematic, partially sectioned side view in accordance with that in FIG. 3, in which the screw head is in the clamping position.

The screw head 10 has on a carrier 12 a gripping part 13 for grasping a closure (not shown) for the container and is actuable between a release position according to FIG. 3 and a clamping position according to FIG. 4.

The gripping part 13 is embraced by a sliding cage 14, which is configured to actuate the gripping part 13 by relative movement. Both the gripping part 13 and the sliding cage 14 are configured as a monolithic component. The two are intertwined in such a way that parts of the sliding cage 14, namely arms 15, reach through openings 16 in the gripping part 13 into the interior 17 thereof, and there as far as a lifting apparatus 18 in the carrier 12.

As can be seen, in particular, from FIG. 1, the openings 16 in the gripping part 13 consist of approximately slit-like vertical wall apertures 19 in a wall part 20 of the gripping part 13. In the drawings, the wall part 20 passes upward into a therewith integral holder 21, on which is configured a flange with which the holder 21 is detachably fastened to the carrier 12, for example by means of screws. In the drawings, extending downward from the wall part 20 are therewith integral gripping arms 22, 23 and 24, which at the lower end have respective gripping jaws 25, 26 and 27. The gripping jaws 25 to 27 have inlays, for example of soft elastic material, for example rubber.

The gripping arms 22 to 24 are relative to the wall part 20 elastic and movable, due to joints 28, 29 in the form of material thin points of the gripping arm material. The joints 28, 29 in the form of the material thin points are permanently elastic.

In the shown illustrative embodiment, the gripping part 13 has three gripping arms 22 to 24 arranged at approximately equal peripheral angular distances apart. Self-evidently, in another illustrative embodiment (not shown), two gripping arms, or four or more gripping arms, for example, can instead be provided. Since the gripping part 13 is connected via the holder 21 at the end of the wall part 20 fixedly to the carrier 12, the movement of the carrier 12 is imparted to the gripping part 13, which exercises the same movement.

The sliding cage 14 has, as the lower element cooperating with the gripping arms 22 to 24, an annular part 30, which is integrally connected to the arms 15 via respective connecting struts 31. The annular part 30 forms a portion which tapers approximately frustoconically in an axial direction, to be precise in the upward direction in the drawings. With this portion in the form of the annular part 30, the sliding cage 14 can bear against facing outer surfaces 32, 33 of the gripping arms 22, 23 and, in the clamping position, exercise a radially inwardly directed movement and clamping force of the gripping arms 22, 23.

The sliding cage 14 preferably has on the tapered portion in the form of the annular part 30, on the inside, metal covers 34 to 36, which form the contact surfaces for the outer surfaces 32, 33 and contribute to the smoothness of movement and low wear between the friction surfaces.

It is particularly advantageous if the gripping part 13, as a one-piece component consisting of holder 21, wall part 20, joints 28, 29 and gripping arms 22 to 24, is formed of plastic, in particular, for example, of polyamide.

In the same way, the sliding cage 14, as the described one-piece structural unit, can also consist of plastic, for example polyamide.

The gripping part 13 contains in particular in the lower region of the gripping arms 22, 23, inside these, cavities 37, 38, which are here provided close to the end region and serve to save weight. In addition, above these in the region of the outer surfaces 32, 33, cavities 39, 40 can be contained in the gripping arms 22, 23, which cavities are approximately slot-hole-like. As a result, a particular elasticity is conferred in this region to each gripping arm 22, 23, whereby, in the clamping position of the screw head 10, the radially inwardly acting closing force of the gripping arms 22 to 24 is evenly transmitted by these to the closure to be screwed, for example a screw cap.

The gripping part 13 contains a central tube 41, which on the end-face end bears an elastic axial ring 42. By the tube 41, the mounting depth of the screw head 10 onto a closure, for example a screw cap, is predefined. For this purpose, the axial ring 42 forms an elastic stop and can, where necessary, also ensure a seal. Radiating from the tube 41 are radial, therewith integral arms 43, 44, 45, via which an expansion element 46, consisting, for example, of an enveloping O-ring, is clamped. This expansion element 46 bears from the inside against projections 47, 48 and 49 of the gripping arms 22 to 24. In the release position according to FIG. 3, the expansion element 46 is untensioned. In the clamping position according to FIG. 4, the projections 47 to 49 of the gripping part 13 act on the expansion element 46 radially from the outside inward in such a way that this is clamped in a spring-like manner. Upon release of the gripping part 13, the expansion element 46 can act in the release position radially outward on the gripping arms 22 to 24. It forms a return element, which supports the elastic return of the gripping arms 22 to 24.

Between the gripping part 13 and the sliding cage 14 is arranged in the interior 17 an elastic return element 50 which acts on both, for example in the form of a cylindrical helical spring for the sliding cage 14.

On the part 51 which extends inside the wall part 20 and inside the holder 21 of the gripping part 13 and can there be configured, for example, approximately as a cylinder sleeve, which contains the return element 50, the sliding cage 14 bears a thereto fastened plunger 52, which is guided in the interior 17 of the carrier 12. The interior 17 of the carrier 12 is configured as a cylindrical pressure chamber 53 for the plunger 52. The pressure chamber 53 forms together with the plunger 52 the lifting apparatus 18, by means of which, when the pressure chamber 53 and the there-situated side of the plunger 52 are pressurized, the plunger 52 can be moved together with the sliding cage 14 relative to the gripping part 13 into the clamping position counter to the action of the return element 50, under actuation of the gripping part.

If, starting from the release position shown in FIG. 3, a pressure medium, for example compressed air, is led under pressure into the pressure chamber 53, then that plunger side of the plunger 52 which is facing toward the pressure chamber 53 is pressurized, whereby the plunger 52, together with the part 51 and the other components of the one-piece sliding cage 14, is displaced downward in FIG. 3 in the arrow direction 54. The sliding cage 14, in particular its conical annular part 30, here slides along the gripping arms 22 to 24, whereupon, due to the conical design of the annular part 30, the gripping arms 22 to 24 are moved radially inward into the clamping position shown in FIG. 4, in which position a closure, for example a screw cap, is clasped by means of the gripping jaws 25 to 27. For the creation of the release position according to FIG. 3, air is removed, for example, from the pressure chamber 53, so that the return element 50, which at the end face is supported against the fixed gripping part 13, can displace the sliding cage 14, in opposite direction to the arrow 54, back into the release position according to FIG. 3. The gripping arms 22 to 24 are hereupon moved, with the aid of the expansion element 46, radially outward into the release position according to FIG. 3.

The one-piece design of the gripping part 13 on the one hand, and of the sliding cage 14 on the other hand, in particular from plastic, can be cost-effectively produced in a particularly advantageous manner by means of lasers in a sintering process, which also favors production in the described intertwined design.

The screw head 10 of the described type has various advantages. The number of individual components is considerably reduced. In addition, the weight of the screw head, also due to lighter material, is substantially reduced. The described component parts of the screw head are able to be produced in a simple and cost-effective manner. Overall, the screw head 10 is considerably cheaper in comparison with known traditional screw heads. The obtained compact construction, wherein, due to the permanently elastic joints formed by thin points of the same material, no distinct joints are necessary for the gripping arms 22 to 24, is also advantageous. A further advantage lies in an obtained reduction of the moment of inertia of the screw head 10, the result of which is that, upon use, faster cycle times are possible in respect of the screwing.

Advantageously, the plunger 52 can be connected to the part 51 of the sliding cage 14 by bayonet closure, so that, in this respect to, a simplified design is obtained. The one-piece design of the gripping part 13, and of the sliding cage 14, from plastic, for example polyamide, is possible through production of these elements by laser sintering in a rapid prototyping process, and thus in a cost-effective and precise manner. As a result of cavities 37 to 40 in the gripping arms 22 to 24 of the gripping part 30, an additional weight reduction is possible, in addition to which these cavities, in particular the cavities 39, 40, are to this extent usable for transmitting the closing force evenly through the gripping arms 22 to 24 to the closure to be screwed.

The invention claimed is:

1. A closing device, having a rotationally drivable screw head for screwing a closure onto a container, the closing device comprising:

a carrier;

a gripping part, supported by the carrier, for grasping the closure, the gripping part having an interior, and the gripping part adapted to move between a release position and a clamping position;

a lifting apparatus supported by the carrier;

a sliding cage, connected to the lifting apparatus, embracing the gripping part and adapted to move relative to the gripping part in order to cause movement of the gripping part between the release position and the clamping position; and wherein both the gripping part and the sliding cage are configured as a monolithic component and the gripping part and the sliding cage are intertwined in such a way that parts of the sliding cage extend through openings in the gripping part and into the interior thereof and as far as the lifting apparatus within the carrier.

2. The closing device as claimed in claim 1, wherein the gripping part has a holder, which is fastened to the carrier, and the gripping part comprises a plurality of individual gripping arms integrally connected via joints to the holder, the joints comprise material thin points of the gripping arms.

3. The closing device as claimed in claim 2, wherein the sliding cage has a frustoconically tapered portion adapted to bear against associated outer surfaces of the gripping arms and generate a radially inwardly directed movement and clamping force of the gripping arms.

4. The closing device as claimed in claim 3, wherein the sliding cage has metal covers on an inside of the tapered portion.

5. The closing device as claimed in claim 2, wherein the gripping arms have gripping jaws at the ends thereof.

6. The closing device as claimed in claim 2, wherein the gripping arms contain, at least at their ends, inner cavities.

7. The closing device as claimed in claim 5, wherein the gripping jaws have elastic inlays.

8. The closing device as claimed in claim 7, wherein the elastic inlays are made of rubber.

9. The closing device as claimed in claim 2, wherein the gripping part comprises a central tube, on which is held, by means of radiating arms, an expansion element which bears from the inside against the gripping arms and, in the clamping position, is clamped in a spring-like manner by the gripping arms and which, in the release position, acts on the gripping arms in the direction of release, radially from the inside outward.

10. The closing device as claimed in claim 9, wherein on an end-face end of the tube is arranged an elastic axial ring.

11. The closing device as claimed in claim 9, wherein the expansion element is an O-ring.

12. The closing device as claimed in claim 1, wherein the gripping part and/or the sliding cage are formed of plastic.

13. The closing device as claimed in claim 12, wherein the gripping part and/or the sliding cage are formed of polyamide.

14. The closing device as claimed in claim 12, wherein the gripping part and/or the sliding cage are produced in a laser sintering process.

15. The closing device as claimed in claim 1, wherein between the gripping part and the sliding cage is arranged in the interior thereof a coaxial elastic return element for raising the sliding cage.

16. The closing device as claimed in claim 15, wherein the carrier includes a cylindrical pressure chamber, and the lifting apparatus further comprises a plunger movable within the cylindrical pressure chamber, and wherein the sliding cage is connected to the plunger, such that when the cylindrical pressure chamber is pressurized, the plunger moves together with the sliding cage, counter to the action of the return element, and such that the movement of the sliding cage, relative to the gripping part, causes the movement of the gripping part into the clamping position.

17. The closing device as claimed in claim 15, wherein the coaxial elastic return element is a spring.

18. The closing device as claimed in claim 1, wherein the closure is a screw cap.

19. The closing device as claimed in claim 1, wherein the closing device is adapted for screwing a closure on a container comprising bottles, jars, pots or packaging containers for pharmaceutical or cosmetic products.

* * * * *